US007806787B1

(12) United States Patent
Gamboa

(10) Patent No.: US 7,806,787 B1
(45) Date of Patent: Oct. 5, 2010

(54) FOOTBALL HANDOFF TRAINER

(75) Inventor: Ricardo Gamboa, Monterey Park, CA (US)

(73) Assignee: Borg Unlimited Inc., Monterey Park, CA (US)

( * ) Notice: Subject to any disclaimer, the term of this patent is extended or adjusted under 35 U.S.C. 154(b) by 0 days.

(21) Appl. No.: 12/489,183

(22) Filed: Jun. 22, 2009

(51) Int. Cl.
*A63B 69/00* (2006.01)

(52) U.S. Cl. ..... 473/438

(58) Field of Classification Search ..... 473/438–445; 248/121
See application file for complete search history.

(56) References Cited

U.S. PATENT DOCUMENTS 3,534,958 A * 10/1970 Lipscomb ..... 473/439
4,477,076 A * 10/1984 Monaco ..... 473/441
4,906,001 A * 3/1990 Vaughn ..... 473/438
6,050,906 A * 4/2000 Stout et al. ..... 473/438
6,077,204 A * 6/2000 Dickinson, Jr. ..... 482/83
6,199,804 B1 * 3/2001 Donofrio, Jr. ..... 248/121
6,575,852 B2 * 6/2003 Orner ..... 473/438
2002/0165047 A1 * 11/2002 Nunnely et al. ..... 473/438

* cited by examiner

*Primary Examiner*—Mark S Graham
(74) *Attorney, Agent, or Firm*—Kelly Lowry & Kelley, LLP; Scott W. Kelley

(57) ABSTRACT

The football handoff trainer includes a vertical stand having a base and a post extending upwardly therefrom. The post includes a support and a vertically positionable extension telescopingly received by the support. An arm is pivotally coupled to the extension and includes a football holder extending therefrom at an end opposite the stand. The football holder releasibly retains a football and cooperates with the arm to simulate a football handoff.

31 Claims, 5 Drawing Sheets

FOOTBALL HANDOFF TRAINER

BACKGROUND OF THE INVENTION

The present invention relates to a football handoff trainer. More particularly, the invention relates to a trainer wherein a football player may practice fundamental handoff techniques individually.

Professional football has evolved into a multi-billion dollar business industry through advertising, merchandising and television contracts. With such increased growth in the industry in recent years, players are now, more than ever, competing among one another for lucrative multi-million dollar contracts. Thus, the demand for performance enhancement football training tools has grown dramatically.

There are two aspects that are important to a football offense: (1) the running game; and (2) the passing game. A two-dimensional football team must have offensive players capable of both running and passing. One crucial aspect of the running game is the delivery of the football from one player to another, i.e. the "handoff". The most common handoff occurs between the quarterback and a running back or a fullback. This handoff typically occurs shortly after the football is snapped from the center to the quarterback. In some cases, a wide receiver may run across the field to take the handoff from the quarterback or the running back. Such plays (e.g. "reverses", "end-arounds", etc.) are typically designed to deceive or trick the defense. Importantly, the quarterback, the running back, the fullback and even the wide receiver must learn proper football handoff techniques to efficiently transfer possession of the football from one player to another. One difficult aspect of training football players in this regard is practicing correct football handling and transferring techniques accurately and repetitively. One general drawback known in the art is that at least two people are required to practice the technique. If the football handoff technique is not executed properly, the football player is likely to fumble the football, which may result in a turnover causing the team to lose control of the game.

Receiving a handoff involves learning fundamental footwork and football handling skills to facilitate a smooth and efficient transfer. For instance, it is important that the running back does not step on or otherwise trip over the quarterback during the handoff. It is also crucial that the running back protect the football to minimize the chances of fumbling the football after receiving the football from the quarterback. The quarterback may initially hide the football with the arms or body for some time after the football is snapped in order to deceive the defense. The quarterback may then turn toward the running back with outstretched arms and the football in hand. The football is handed directly from the quarterback to the running back without leaving the hands of the quarterback. To receive the football, the running back positions one arm across the upper chest, palm down, and the other arm across the stomach, palm up. The arm in the upper position should be the one closest to the quarterback. This forms a so-called "pocket" or "pouch" for the quarterback to place the football. The quarterback positions the football horizontally and places the football in the pocket area formed by the running back. Once the football hits the chest and stomach area, the running back clamps down on the football with the top arm and locks the football with the bottom arm and the quarterback releases the football. This preferred handoff technique helps prevent fumbling and conceals the football in the arms of the running back.

There are a number of training techniques designed to enhance football handoff skills. One common technique, as briefly described above, is a practice drill involving three players. The first player (quarterback) takes a snap from a second player (center) and turns to handoff the football to a third player (running back). A coach or other instructor may watch these players practice and provide further instructions to the quarterback, the running back or the center. One drawback to this technique is that the drill is heavily reliant upon the footwork and correct positioning of the football by the quarterback. The running back will only be able to properly practice the handoff techniques described pending the quarterback is able to turn and place the football in the proper position for the running back to receive. A quarterback unable to adequately position the football increases the difficulty of the running back to practice the proper handoff techniques. In turn, this might necessitate that the training sequence be slowed down to below game speed so the quarterback can work on footwork and ball placement. All the while, the running back is not able to practice handoff skills at game speed. Moreover, the prior art fails to disclose a device that enables running backs, quarterbacks and/or wide receivers to practice the fundamental football handoff skills alone.

Thus, there exists a significant need in the art for a football handoff trainer that teaches the fundamental techniques of properly receiving a football handoff. Such a football handoff trainer should include a portable stand, an arm pivotally coupled to the stand, and a football holder at one end of the arm extending away from the stand, wherein the football holder releasibly retains a football and cooperates with the arm to simulate a football handoff. The football player should be able to adjust the football handoff trainer in height, weight and length in order to practice proper handoff techniques in simulated game-type handoff situations. The present invention fulfills these needs and provides further related advantages.

SUMMARY OF THE INVENTION

The football handoff trainer includes a vertical stand and an arm having a football holder coupled thereto. The arm is pivotally coupled to the stand and pivots about a pin that is selectively engageable with the stand and the arm. The football holder extends from the arm at an end opposite of the stand and releasibly retains a football to simulate a football handoff in cooperation with the arm. A spring may couple between the stand and the arm to resist rotational movement of the arm during the football handoff. This enables the football player to practice both right handed and left handed handoffs. Accordingly, the spring imparts the type of resistance the football player may experience when receiving the handoff from another football player. In a preferred embodiment, the spring is a torsion spring. Moreover, the stand should also include a compartment for storing a portable weight. The portable weight may include water, sand or another weighted material selectively separable from the stand.

The stand itself preferably includes a base and a post extending upwardly therefrom. In one embodiment, the post includes a support and a vertically positionable extension telescopingly received by the support. In this embodiment, the arm attaches directly to the extension. Alternatively, the arm may pivotally couple to the post and extend beyond the width of the base. A lock may selectively slidingly engage the stand to position the extension between a retracted position and an extended position. In another aspect of the football handoff trainer, the support selectively detaches from the base to enhance portability.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
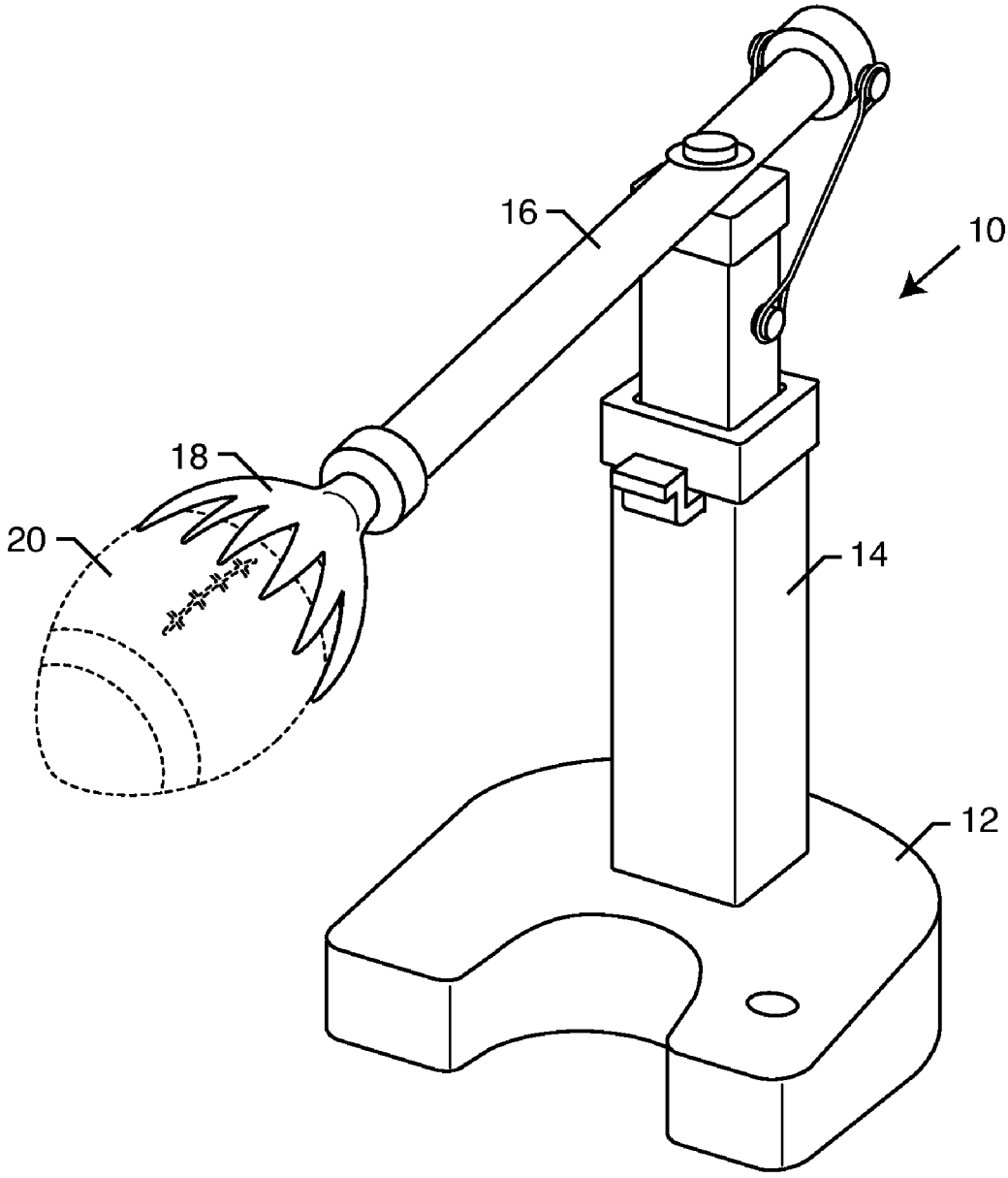
FIG. 1 is a perspective view of the football handoff trainer, illustrating retention of a football.

As shown in the drawings for purposes of illustration, the present invention for a football handoff trainer is referred to generally by the reference number 10. The football handoff trainer 10 is designed to replace the quarterback to enable a football player to individually practice football handoff techniques. Virtually any offensive, defensive or special teams football player that may receive the football through a handoff during a football game will be able to practice handoffs with the football handoff trainer 10. The football handoff trainer 10 is particularly useful for offensive players, specifically running backs, fullbacks, wide receivers, tight ends and quarterbacks, as these players typically handle the football and conduct the most handoffs during the football game. Moreover, use of the football handoff trainer 10 eliminates other human error factors associated with using a quarterback that may adversely impact practicing proper handoff techniques.

As shown in FIG. 1, the football handoff trainer 10 includes a base 12, a vertically extending post 14 and a horizontally extending arm 16 coupled to the post 14. A holder 18 extends from the arm 16 at an end opposite the base 12 and is designed to releasably retain a football 20. The football handoff trainer 10 includes a variety of mechanisms wherein the base 12, the post 14, the arm 16 and the holder 18 adjust, as described in more detail below, to enable a football player to selectively position the football 20 in order to practice proper football handoff techniques. The football handoff trainer 10, including the base 12, the post 14, the arm 16 and the holder 18, is manufactured from substantially rigid materials capable of withstanding repetitious football-type contact at game speeds. For example, a football player may contact the football handoff trainer 10 with hard plastic (comparable to shoulder pad materials), padding, or other protective gear such as rib or chest guards. Accordingly, the base 12 or the post 14 may be manufactured from a solid material such as metal, steel, hard plastic, etc. Preferably, the arm 16 and/or the holder 18 is manufactured from a rigid plastic-type material that retains its structural integrity when subjected to football-type contact, yet does not cause injury to a football player repetitiously using the football handoff trainer 10. In one embodiment, the arm 16 or the holder 18 may include a pad to soften any contact between the football player practicing handoffs and the football handoff trainer 10.

Figure 5:
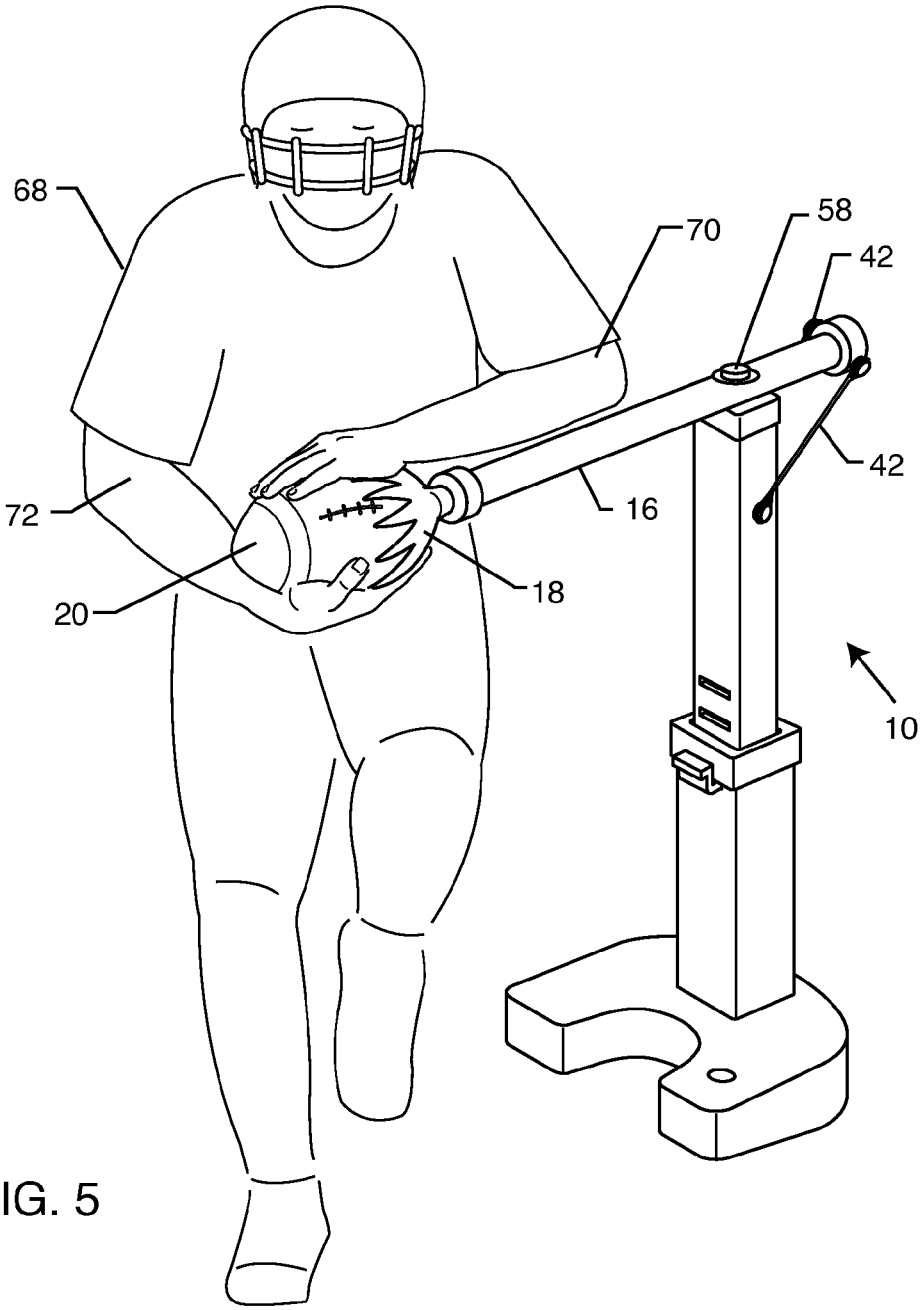
FIG. 5 is an environmental view illustrating use of the football handoff trainer by a running back.

The size and weight of the base 12 should stabilize the football handoff trainer 10 during use. Specifically, the base 12 should ensure that the football handoff trainer 10 does not tip over, rotate or otherwise move when a football player contacts the arm 16 or the holder 18. For example, the weight of the base 12 may provide stabilization by lowering the overall center of gravity of the football handoff trainer 10. Here, the weight of the base 12 counteracts the moment created when the football player contacts the arm 16 and/or the holder 18. The base 12 may further secure to the ground through hooks or stakes to provide additional stabilization. The width of the base 12 may also be sized to mitigate any potential for tipping or rotating, while allowing the football player to freely contact the arm 16 and/or the holder 18 without tripping over the base 12. In this regard, the size of the base 12 should provide enough clearance so the football player may practice taking handoffs while simultaneously practicing footwork. The length of the arm 16 should at least be sized so the football player may run through the holder 18 as generally shown in FIG. 5.

The post 14 of the football handoff trainer 10 may be integrated with the corresponding base 12 in one of several embodiments. In one embodiment, the post 14 rigidly attaches to the base 12 and does not adjust relative to the base 12. Such a design may be particularly desirable for use in youth football leagues where the players are all relatively the same height. Alternatively, the post 14 selectively detaches from the base 12. This may be particularly desirable if the football handoff trainer 10 is to be unassembled for storage or for transportation between locations. The detachability of the post 14 also enables a user to interchange the post 14 with other posts that may vary in size. The height and weight of the post 14 can be important in terms of structural integrity, cost, storage, transportation, compatibility, etc.

Preferably, the post 14 is at least somewhat adjustable so a user may vertically position the arm 16 and the holder 18 for use with football players that vary in height. For example, a football team may have multiple running backs or fullbacks that vary in height. To enhance compatibility of the football handoff trainer 10, this requires that the holder 18 be able to locate the football 20 at variable vertical positions so the football player may practice proper handoff skills. Selective vertical positioning of the holder 18 can be accomplished through use of multiple interchangeable posts 14 that vary in height or through use of a single post 14 that is selectively vertically positionable. For example, the arm 16 may be vertically positionable through use of a telescoping extension integral to the post 14, as described with respect to FIGS. 2 and 3 below. Preferably, the football 20 is positioned at a height wherein the football player receives the football 20 in the so-called "pouch" or "pocket" area formed through respective positioning of the upper arm relative to the lower arm.

Figure 2:
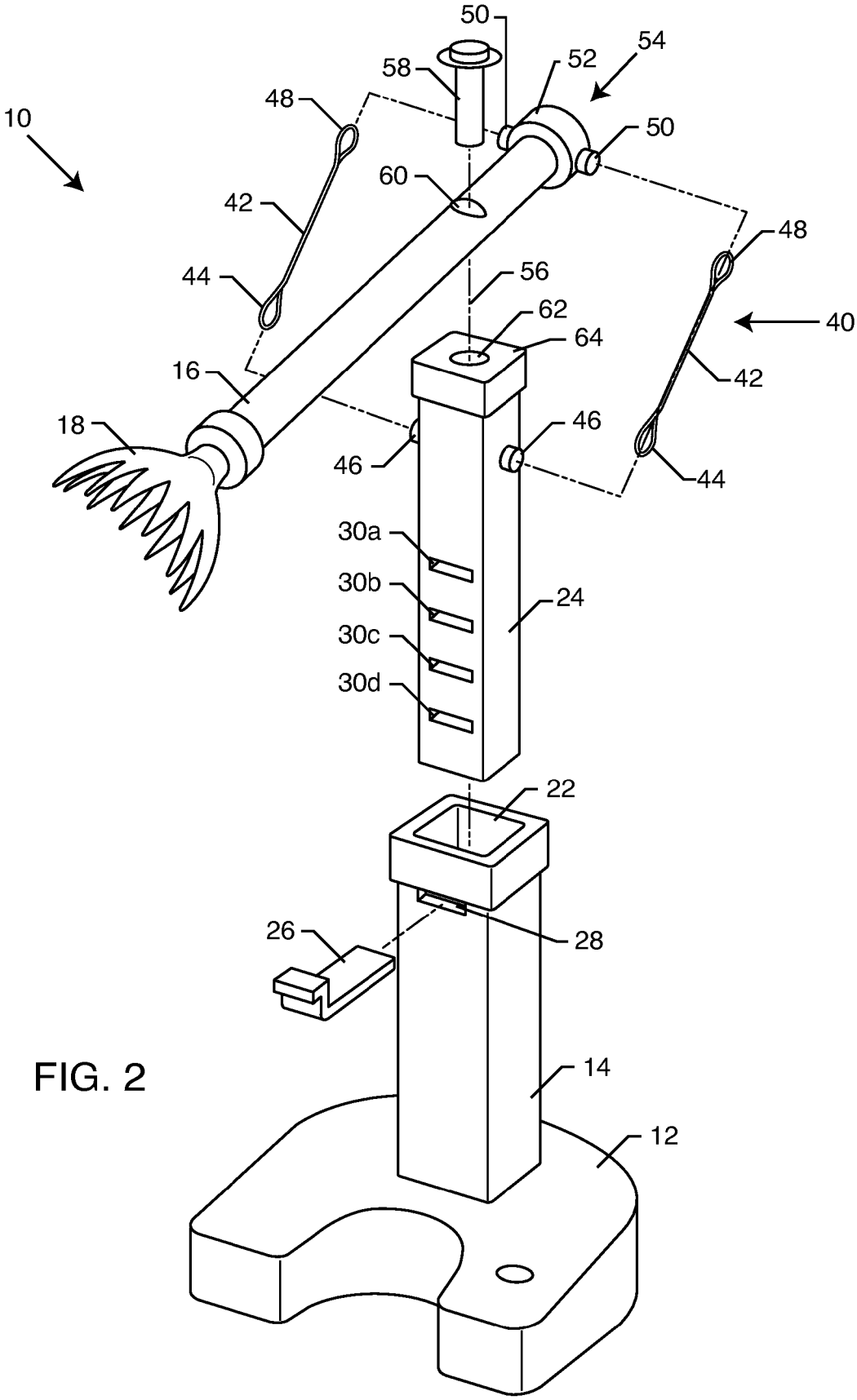
FIG. 2 is an exploded perspective view of the football handoff trainer of FIG. 1.

FIG. 2 illustrates an exploded perspective view of the football handoff trainer 10. The post 14 rigidly attaches to the base 12 by any mechanical mechanism known in the art. In the embodiment wherein the post 14 permanently attaches to the base 12, the mechanical attachment mechanism may include welding. Alternatively, when the post 14 selectively removably attaches to the base 12, such a mechanical mechanism may include interlocking engagement members, hooks, snaps or other comparable attachment means known in the art. The post 14 should not move or shift relative to the base 12, especially when the post 14 removably attaches to the base 12. This ensures that the handoff trainer 10 may be used to simulate football-type situations that require frequent contact. FIG. 2 further illustrates the post 14 having a channel 22 for telescopingly receiving an extender 24. The extender 24, like the post 14, is rigid and preferably manufactured from substantially resilient materials, such as metals, steel alloys, hard plastics, etc. The extender 24 should be capable of handling torsional forces imparted thereon resultant from repetitive contact by a running back with the holder 18 and pivoting of the corresponding arm 16. A football player may selectively adjust the height of the arm 16 with the extender 24. In this embodiment, the extender 24 replaces the need to house a stock of multiple interchangeable posts 14 that vary in height. The extender 24 is further preferred as the height of the arm 16 may be quickly adjusted without detaching and replacing the post 14.

Figure 3:
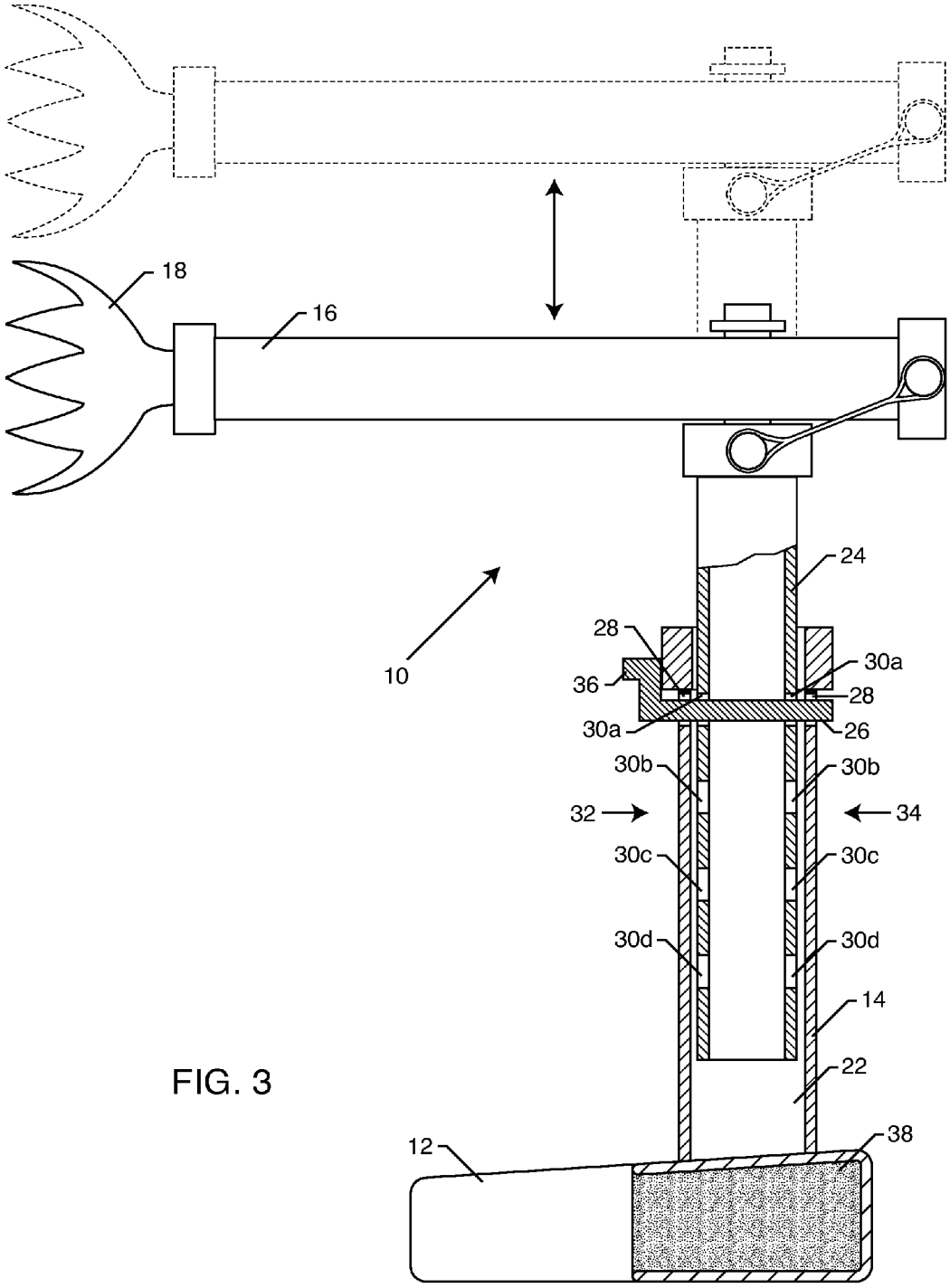
FIG. 3 is a side view of the football handoff trainer, illustrating vertically positioning a pivot arm of the football handoff trainer.

The extender 24 resides within the channel 22 and is secured at a desired height through use of a lock 26. The lock 26 is selectively insertable into a slot 28 formed through the width of the post 14. The lock 26 is then selectively insertable into any one of a plurality of slots 30*a*-30*d* formed through the body of the extender 24. The vertical position of the arm 16 is dependent upon which slot 30*a*-30*d* the lock 26 engages. For example, FIG. 3 is a partial cross-sectional view of the post 14 and the extender 24 residing in the channel 22. FIG. 3 illustrates the relative positioning of the extender 24 within the channel 22 from a retracted position (shown in solid lines) to an extended position (shown in phantom). As shown, the slot 28 extends through a front side 32 and a backside 34 of the post 14. The slots 30*a*-30*d* also extend through the width of the extender 24. Accordingly, the length of the lock 26 is sized to extend through the width of the post 14 and the extender 24 to simultaneously engage the slot 28 and the selected slot 30*a*-30*d*. Preferably, a portion of the lock 26 extends out of the back side 34 to ensure stability. The football handoff trainer 10 is initially positioned in the retracted position such that the lock 26 is inserted through the slot 28 in the post 14 and the corresponding slot 30*a* in the extender 24. Changing the vertical height of the arm 16 to that shown in phantom requires removing the lock 26 out from within the slots 28 and 30*a*. The user may grasp a ledge 36 protruding horizontally out from the lock 26 for better grip. The ledge 36 may include a non-slip surface that enables a user to adequately grasp the lock 26 for easy insertion and removal. Accordingly, the lock 26 must be completely removed from within the post 14 and the extender 24 before a user may vertically position the extender 24. Once the lock 26 is completely removed, the extender 24 moves freely within the channel 22 and may even be completely removed therefrom. Accordingly, the football handoff trainer 10 may include multiple extenders 24 that have variously positioned slots 30. Of course, each extender 24 would be configured differently. This feature further enhances the vertical adjustability of the arm 16 and the holder 18. Removability also enables the user to compactly disassemble the football handoff trainer 10 for storage or transportation. To increase the height of the football handoff trainer 10 to the position shown in phantom in FIG. 3, a user may align any one of the slots 30*b*-30*d* with the slot 28 for reinsertion and retention of the lock 26 therein. In doing so, the football player selectively positions the height of the arm 16 and the corresponding holder 18 to a specific height for proper use of the football handoff trainer 10. As described above, the holder 18 should vertically align with the so-called "pouch" or "pocket" area formed by the arms of the football player. A person of ordinary skill in the art will readily recognize that the extender 24 or the post 14 may include more or less slots 28, 30 to facilitate the adjustability of the football handoff trainer 10.

FIG. 3 also shows a weight 38 integrated into the base 12 to enhance the stability of the football handoff trainer 10. The weight 38 helps lower the center of gravity of the football handoff trainer 10 down toward the top of the base 12. A low center of gravity is preferred so the football handoff trainer 10 does not tip over during use. In one embodiment, the weight 38 is integrated into the base 12 as a solid piece of material, such as metal. In an alternative embodiment, the weight 38 is selectively insertable or removable from within the interior of the base 12. Here, the base 12 may include a compartment where the weight 38 is stored. A user may selectively access the weight 38 in the storage compartment via a latch or other door-type mechanism. Selective removal of the weight 38 from within the compartment enables a user to decrease the overall weight of the football handoff trainer 10 during transportation. Alternatively, the weight 38 may comprise water or sand that can be selectively added or removed from the base 12, as desired. In this embodiment, the weight 38 may be accessed via an access opening located in the perimeter of the base 12. Enabling the user to selectively remove the weight 38 from within the interior of the base 12 further increases the mobility of the football handoff trainer 10, especially if the user endeavors to transport the football handoff trainer 10 from one location to another. For example, when the weight 38 comprises water, the user may drain the water out from within the base 12 before transporting the football handoff trainer 10. Preferably, the water may be drained directly to the field. Then, the user transports the relatively lighter football handoff trainer 10 to the desired location and subsequently refills the base 12 with water. In this embodiment, the user is not required to actually carry the weight 38 from location to location.

A reflexive mechanism 40 associated with the extender 24 and the arm 16 is best illustrated in FIG. 2. The reflexive mechanism 40 is designed to simulate the type of resistance a running back may experience from the arms of a quarterback when receiving a game-time handoff. The reflexive mechanism 40 is also designed to realign the positioning of the arm 16 such that the football handoff trainer 10 resets after use. The reflexive mechanism 40 includes a pair of springs 42 that exert torsional reflexive forces on the arm 16 and the extender 24. Each spring 42 includes a lower loop 44 that selectively engages a protruding retainment member 46 extending outwardly from the body of the extender 24. Likewise, each spring 42 also includes an upper loop 48 that selectively engages a corresponding upper retainment member 50 formed on a mounting bracket 52 on a rear end 54 of the arm 16. The loops 44, 48 securely attach to the corresponding retainment members 46, 50 and should not loosen or disconnect therefrom during use. The loops 44, 48 may snap or clip into the retainment members 46, 50, or may actually be welded thereto for permanent engagement therewith. Although, it is preferable that the springs 42 removably attach to the retainment members 46, 50 such that a user may disassemble the football handoff trainer 10 for transportation or storage.

Figure 4:
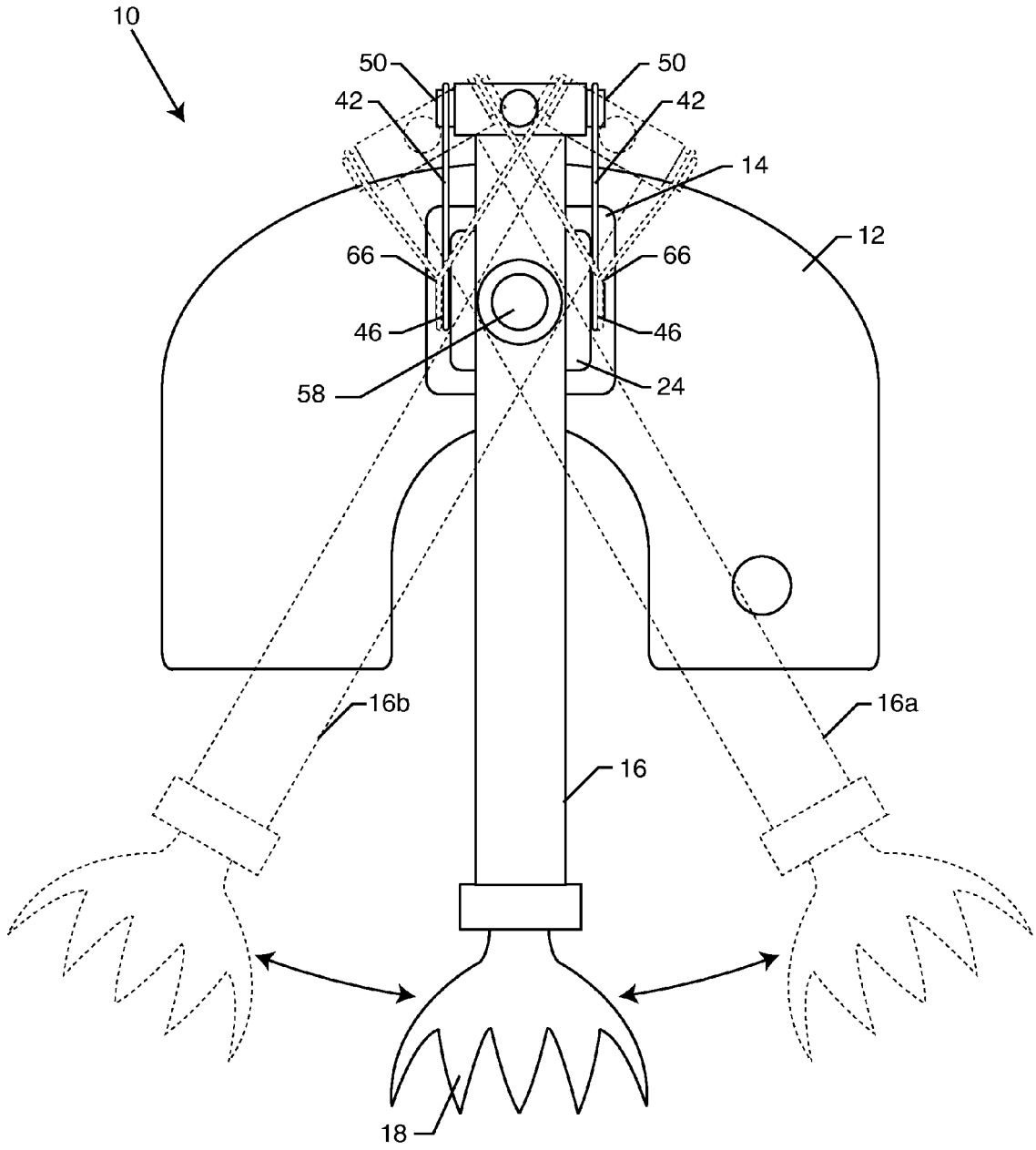
FIG. 4 is a top view of the football handoff trainer, illustrating rotational movement of the pivot arm.

Use of the football handoff trainer 10 necessarily requires that the football player contact and rotate the arm 16. The arm 16 rotates about an axis 56 that is concentric with a pivot pin 58 that extends through an aperture 60 in the width of the arm 16 and into a corresponding receptacle 62 formed in a top surface 64 of the extender 24. The springs 42 are designed to realign the arm 16 as it pivots about the axis 56 after contact by the football player. FIG. 4 specifically illustrates movement of the arm 16 about the pivot pin 58. As described above, the football handoff trainer 10 is designed so a user may practice receiving a handoff from both the right hand side and the left hand side. Hence, the arm 16 is capable of rotating both to the right (counterclockwise movement) and to the left (clockwise movement) as shown in FIG. 4. Rotation of the arm 16 about the pivot pin 58 in conjunction with the reflexive mechanism 40 allows the football player to practice both right handed and left handed handoffs without reconfiguring any of the components of the football handoff trainer 10. Being able to practice both right handed and left handed handoffs is particularly desirable because football players are often required to run plays from both sides of the field. For example, a coach may call a play that requires the running back to receive a right handed handoff. But, after lining up at the line of scrimmage, the coach or quarterback may change the play so the running back receives a left handed handoff. Coaches or quarterbacks often change plays to exploit weaknesses in the defense. Hence, the symmetrical design of the football handoff trainer 10 enables the arm 16 to pivot both counterclockwise and clockwise about the pivot pin 58 so the football player may practice receiving a handoff from both the right hand side and the left hand side.

In general, a football player receiving a left handed handoff contacts the holder 18 and rotates the arm 16 counterclockwise. As shown in FIG. 4, this causes movement of the arm 16 to the positioning of the arm 16*a* and causes the springs 42 to bend at a pair of bend points 66. The springs 42 resist the counterclockwise movement of the arm 16, thereby exerting some degree of resistance to the "pouch" or "pocket" area of the football player during the handoff. Accordingly, the springs 42 exert a torsional reflexive force on both the arm 16 and the extender 24 at the position of the lower retainment members 46 and upper retainment members 50, respectively. The springs 42 realign the arm 16 after the football player receives the handoff from the holder 18 and no longer contacts the arm 16 or the holder 18. Hence, the reflexive force ushers the positioning of the arm 16*a* clockwise back to the positioning of the arm 16. The springs 42 exert a similar torsional resistance when the football player practices receiving right handed handoffs. Here, the springs 42 resist the clockwise rotational movement of the arm 16, thereby providing some degree of resistance to the football player during the handoff. Again, movement of the arm 16 to the positioning of the arm 16*b* causes the springs 42 to bend at the bend points 66. This causes the springs 42 to exert the torsional reflexive force on both the arm 16 and the extender 24 at the position of the lower retainment members 46 and the upper retainment members 50, respectively. After the football player removes the football 20 from the holder 18 and is no longer contacting the football handoff trainer 10, the springs 42 again realign the arm 16*b* to the resting position of the arm 16. The springs 42 are designed to resist rotational movement of the arm 16 to both the position of the arm 16*a* and the arm 16*b*. Accordingly, the reflexive mechanism 40 effectively maintains the football handoff trainer 10 in a resting position of the arm 16, as shown in solid lines in FIG. 4.

FIG. 5 is an environmental view illustrating a running back 68 receiving a left handed handoff from the football handoff trainer 10. In this configuration, the running back 68 raises a left arm 70 and lowers a right arm 72 to form the aforementioned "pocket" or "pouch" area. The running back 68 effectively runs into the holder 18 retaining the football 20. Contact with the holder 18 causes rotation of the arm 16, as described above. Upon making contact with the football 20, the running back 68 closes the left arm 70 and the right arm 72 about the football 20, grasps the football 20 and removes the football 20 from within the holder 18. The positioning of the left arm 70 of the running back 68 enables extension of the arm 16 into the so-called "pocket" or "pouch" area. Accordingly, the arm 16 continues to rotate about the pivot pin 58 until the running back 68 no longer contacts the football handoff trainer 10. At this point, the springs 42, as described above, rotate the arm 16 back into a resting position. Similarly, the running back 68 could turn around for a right handed handoff and receive the football 20 with the right arm 72 in the elevated position and the left arm 70 in the lower position. Here, the running back 68 pushes the arm 16 of the football handoff trainer 10 clockwise and receives the football 20 from the right side. Naturally, the arm 16 pivots back to a resting position via the springs 42, as described in detail above. Thus, the running back 68 may practice both right handed and left handed handoffs with the football handoff trainer 10 in one configuration. Moreover, the selective vertical positioning of the arm 16 enables the running back 68 to set the vertical height of the holder 18 to ensure that the running back 68 receives the football 20 within the aforementioned "pocket" or "pouch" area. The running back 68 may then efficiently and repetitively practice receiving a handoff from the football handoff trainer 10 at game speeds. Thus, the running back 68 is not dependent upon a quarterback in order to practice receiving handoffs. The running back 68 is also not subjected to quarterback errors.

Although several embodiments have been described in detail for purposes of illustration, various modifications may be made to each without departing from the scope and spirit of the invention. Accordingly, the invention is not to be limited, except as by the appended claims.

What is claimed is:

1. A football handoff trainer, comprising:

a vertical stand;

an arm pivotally coupled to the stand pivotable in the horizontal plane; and a football holder extending from the arm at an end opposite the stand, wherein the football holder releasably retains a football and cooperates with the arm to simulate a football handoff, wherein the football holder releasably retains either end of a football, thereby leaving the opposite football end and a football center substantially free.

2. The trainer of claim 1, including a spring coupled between the stand and the arm to resist rotational movement of the arm during the football handoff.

3. The trainer of claim 2, wherein the spring comprises a torsion spring.

4. The trainer of claim 1, wherein the stand comprises a base and a post extending upwardly therefrom.

5. The trainer of claim 4, wherein the post comprises a support and a vertically positionable extension telescopingly received by the support, wherein the arm is attached to the extension.

6. The trainer of claim 5, including a lock for selectively positioning the extension between a retracted position and an extended position.

7. The trainer of claim 6, wherein the lock slidingly engages the extension and the support.

8. The trainer of claim 5, wherein the support selectively detaches from the base.

9. The trainer of claim 4, wherein the arm pivotally couples to the post and extends beyond the width of the base.

10. The trainer of claim 1, wherein the stand includes a compartment for storing a portable weight.

11. The trainer of claim 1, including a pin selectively engageable with the stand and the arm, wherein the arm pivots about the pin.

12. A football handoff trainer, comprising:

a vertical stand comprising a base and a post extending upwardly therefrom, wherein the post comprises a support and a vertically positionable extension telescopingly received by the support;

an arm pivotally coupled to the extension and pivotable in the horizontal plane;

a football holder extending from the arm at an end opposite the stand, wherein the football holder releasably retains a football end and cooperates with the arm to simulate a football handoff;

a spring coupled between the extension and the arm to resist rotational movement of the arm during the football handoff; and a lock for selectively positioning the extension between a retracted position and an extended position.

13. The trainer of claim 12, wherein the spring comprises a torsion spring and the support selectively detaches from the base.

14. The trainer of claim 12, wherein the lock slidingly engages the extension and the support and the arm extends beyond the width of the base.

15. The trainer of claim 12, wherein the stand includes a compartment for storing a portable weight.

16. The trainer of claim 12, including a pin selectively engageable with the extension and the arm, wherein the arm pivots about the pin.

17. A football handoff trainer, comprising:

a vertical stand having a compartment for storing a portable weight;

an arm pivotally coupled to the stand pivotable in the horizontal plane;

a pin selectively engageable with the stand and the arm, wherein the arm pivots about the pin;

a football holder extending from the arm at an end opposite the stand, wherein the football holder releasably retains a football end and cooperates with the arm to simulate a football handoff; and a torsion spring coupled between the stand and the arm to resist rotational movement of the arm during the football handoff.

18. The trainer of claim 17, wherein the stand comprises a base and a post extending upwardly therefrom, the post comprising a support and a vertically positionable extension telescopingly received by the support.

19. The trainer of claim 18, including a lock for selectively positioning the extension between a retracted position and an extended position, wherein the arm pivotally couples to the extension and extends beyond the width of the base.

20. The trainer of claim 19, wherein the lock slidingly engages the extension and the support and the support selectively detaches from the base.

21. A football handoff trainer, comprising:

a vertical stand;

an arm pivotally coupled to the stand pivotable in the horizontal plane;

a spring coupled between the stand and the arm to resist rotational movement of the arm during the football handoff; and a football holder extending from the arm at an end opposite the stand, wherein the football holder releasably retains a football and cooperates with the arm to simulate a football handoff.

22. The trainer of claim 21, wherein the spring comprises a torsion spring.

23. A football handoff trainer, comprising:

a vertical stand comprising a base and a post extending upwardly therefrom;

an arm pivotally coupled to the stand pivotable in the horizontal plane; and a football holder extending from the arm at an end opposite the stand, wherein the football holder releasably retains a football and cooperates with the arm to simulate a football handoff;

wherein the post comprises a support and a vertically positionable extension telescopingly received by the support, wherein the arm is attached to the extension.

24. The trainer of claim 23, including a spring coupled between the stand and the arm to resist rotational movement of the arm during the football handoff.

25. The trainer of claim 24, wherein the spring comprises a torsion spring.

26. The trainer of claim 23, including a lock for selectively positioning the extension between a retracted position and an extended position.

27. The trainer of claim 26, wherein the lock slidingly engages the extension and the support.

28. The trainer of claim 23, wherein the support selectively detaches from the base.

29. The trainer of claim 23, wherein the arm pivotally couples to the post and extends beyond the width of the base.

30. The trainer of claim 23, wherein the stand includes a compartment for storing a portable weight.

31. The trainer of claim 23, including a pin selectively engageable with the stand and the arm, wherein the arm pivots about the pin.

* * * * *